United States Patent [19]

Blum

[11] 4,286,738

[45] Sep. 1, 1981

[54] REVOLVING TOWER SUPPORT FOR CASTING LADLES

[75] Inventor: Wilhelm Blum, Junkerath, Fed. Rep. of Germany

[73] Assignee: DeMag Aktiengesellschaft, Duisburg, Fed. Rep. of Germany

[21] Appl. No.: 122,453

[22] Filed: Feb. 19, 1980

[30] Foreign Application Priority Data

Apr. 20, 1979 [DE] Fed. Rep. of Germany ..... 2916042

[51] Int. Cl.[3] ..... B22D 41/00

[52] U.S. Cl. ..... 222/591; 222/607; 222/168; 164/438

[58] Field of Search ..... 164/437, 438; 222/166, 222/168, 590, 591, 604, 605, 606, 607

[56] References Cited

U.S. PATENT DOCUMENTS

| | | | |
|---|---|---|---|
| 3,717,331 | 2/1973 | Simons | 164/438 X |
| 4,199,084 | 4/1980 | Mangraf et al. | 222/591 |

FOREIGN PATENT DOCUMENTS

| | | | |
|---|---|---|---|
| 455300 | 7/1913 | France | 222/604 |
| 743000 | 3/1933 | France | 222/604 |
| 2324396 | 4/1977 | France | 222/591 |

*Primary Examiner*—David A. Scherbel

*Attorney, Agent, or Firm*—Mandeville and Schweitzer

[57] ABSTRACT

An articulated dual rotatable support is provided for casting ladles in which opposed supporting arms extend from an annular central support column which is rotatable. Each support arm may be raised and lowered independently of the other. Each support arm includes a U-shaped support arrangement carrying a ladle receiver. In addition, each support arm is supported in an open topped bearing arrangement so as to be easily lifted out of position for repairs or replacement. A power device for moving each support arm is provided connected to a transverse beam on the rotatable annular support and movable therewithin which power device is connected to an L- or Z-shaped power arm rigidly connected to each supporting arm to provide for the articulation of each supporting arm largely below the top of the annular support.

10 Claims, 2 Drawing Figures

REVOLVING TOWER SUPPORT FOR CASTING LADLES

The invention relates to a revolving tower support for casting ladles with two oppositely extending levers, forked when seen in plan view, essentially symmetrical with the pivot axis of the tower, and each provided at their open ends with a receiver for a casting ladle. The levers pivot at a part of the tower revolving around the tower axis, and tilt to a limited extent on a vertical plane by means of at least one hoisting unit hinged to the revolving tower at one end and to the lever at the other end. A cylinder-piston arrangement is particularly useful, operated by a pressurized fluid. Each lever is provided with two arms firmly connected by means of a cross beam and forms a malleable articulated crank gear with corresponding guides.

It is known that some casting processes, due to the existing operating conditions, require the revolving tower for the transport of casting ladles to be formed in such a way that the casting ladles may be adjusted in height. A revolving tower of this type, where a cantilevered arm, rotatable approximately in horizontal direction and essentially symmetrical with the pivot point, receiving the casting ladles at its two ends, has been disclosed, for example, by German DE-AS No. 20 44 979. The cantilever may be tilted from its horizontal position on a pedestal or pillow block to a limited extent in a vertical plane. Alternately, chargeable hoisting elements are provided on both sides of the swivel joint.

The arrangement of the rigid dual cantilevered arm makes the two casting ladles dependent on each other in height adjustment movements. This dependence, however, has proven to be a disadvantage. In many cases, such as in sequence casting it is necessary, while decanting one ladle in casting position, a second ladle is fit into the other end of the cantilever or the ladle already fitted still requires some preparation. To this end, however, the second ladle must be independently adjustable in height regardless of the position of the first ladle.

This requirement is met by a known revolving tower described in German DE-OS No. 24 30 786 being equipped with two opposite one-arm lever pairs operating independently. These forked lever pairs each pivot around a horizontal pivot pin on the main column of the revolving tower, while the other end of each forked arm is provided with a receiver for the casting ladle. Raising and lowering is effected by means of cylinder-piston arrangements operated by a pressurized fluid, each being hinged to the column at one end and to the lever at the other end. The levers rest in massive axles because of the huge load. These axles, as well as the precision bearings are subject to considerable wear due to the great stresses, which, are aggrevated by the rough conditions of foundry operations.

In case of repairs or renewal of the axles and/or bearings substantial assembly procedures are necessary to expose the axles or bearings for the repair. In addition to this are the disadvantages of the cylindrical bearings, particularly the risk of compressing the edges in case of deformation, expansion or inaccuracies during manufacture or assembly. The bearings are accessible for control and maintenance only with difficulty.

Above all, the arrangement of the hoisting units interfers with the working space in the area of equipment located under the casting ladle spout, thus making the work of the attendants more difficult. This also refers to the work at the slide lock when preparing for the casting process. Also, there is no free space in the area of the revolving tower axis which is necessary for observation and/or minor adjustments. Finally, the pressurized fluid supply lines to and from the pressure cylinders require a bothersome arrangement far outside the main column of the revolving tower due to the arrangement of the cylinders. In case of a sudden pressure drop in the lines special controls must be provided.

It is the object of the invention to provide a revolving tower of the initially mentioned type without the enumerated disadvantages, which is designed so that, while the structure is simplified, the life of the apparatus is extended, and simultaneously operating and safety conditions are improved. In particular the structural height of the revolving tower in the area of the lever system is reduced. Furthermore, a considerable simplification of the maintenance and/or assembly procedures of the lever system is achieved. A completely free space is created below the casting ladle next to the revolving tower main column. The invention solves this by a revolving tower for casting ladles with two opposite levers, forked when seen in plan view, essentially symmetrical with the pivot axes and each provided at their free ends with a receiver for a casting ladle, such levers pivoting at a part of the tower revolving around the revolving tower axis and being tiltable to a limited extent on a vertical plane by means of at least one hoisting unit hinged to the revolving tower at one end and to the lever at the other end, particularly a cylinder-piston arrangement operated by a pressurized fluid, whereby each lever is provided with two arms firmly connected by means of a cross beam and forms a malleable articulated crank gear with corresponding guides, distinguished in that the forked lever (7) is a double arm and is arranged tiltable in bearings (14, 14') open in plan view, connected with the rotating part of the tower, possibly an annular support (3). Advantageous further developments of the invention are contained in the dependent claims attached herewith.

Due to the fact that the levers are not—as previously—arranged so as to pivot around an axis received in the lever, but in bearings open at the top, the lever can, during disassembly, easily be lifted off and/or set onto the bearings during assembly by means of a crane, for example. This makes for a considerable simplification of assembly which is above all advantageous for maintenance, control and repairs.

By the shape of the power arms essentially angled in vertical direction downward, as well as by arranging the pressure cylinders hinged to the bottom of a cross beam attached to the annular support, and the rods attached to the lower arms, a free space remains above the levers in the central area of the revolving tower. Thus, during disassembly of the cylinder and/or the levers, it is only necessary to detach the cross beam connected to the support cylinder by means of screws. The heavy parts are then directly accessible and can be lifted off by means of a crane or other device.

Furthermore, the free space in the central area of the revolving tower can be used for the erection of work scaffolds or platforms to make the ladles more easily accessible. This is of importance for observation, temperature gaging, charging of additives, and so forth. By the arrangement of the hoisting elements in the hollow center of the annular support, there are no structural parts below the lower edge of the ladle, outside the annular support outer diameter, in the casting area, so that the operations in the casting preparation such as the slide lock, and in the spout operation can be carried out unimpeded.

Due to the central arrangement of the cylinder-piston arrangement operated by a pressurized fluid, the installation of pressure lines and/or steering controls is much simplified. As the load side has a constant extra weight vs. the power side, a telescope-like plunger cylinder may be used for further simplification of the hydraulic lines.

The invention is illustrated by way of an example shown in the drawings.

DETAILED DESCRIPTION OF THE INVENTION

Figure 1:
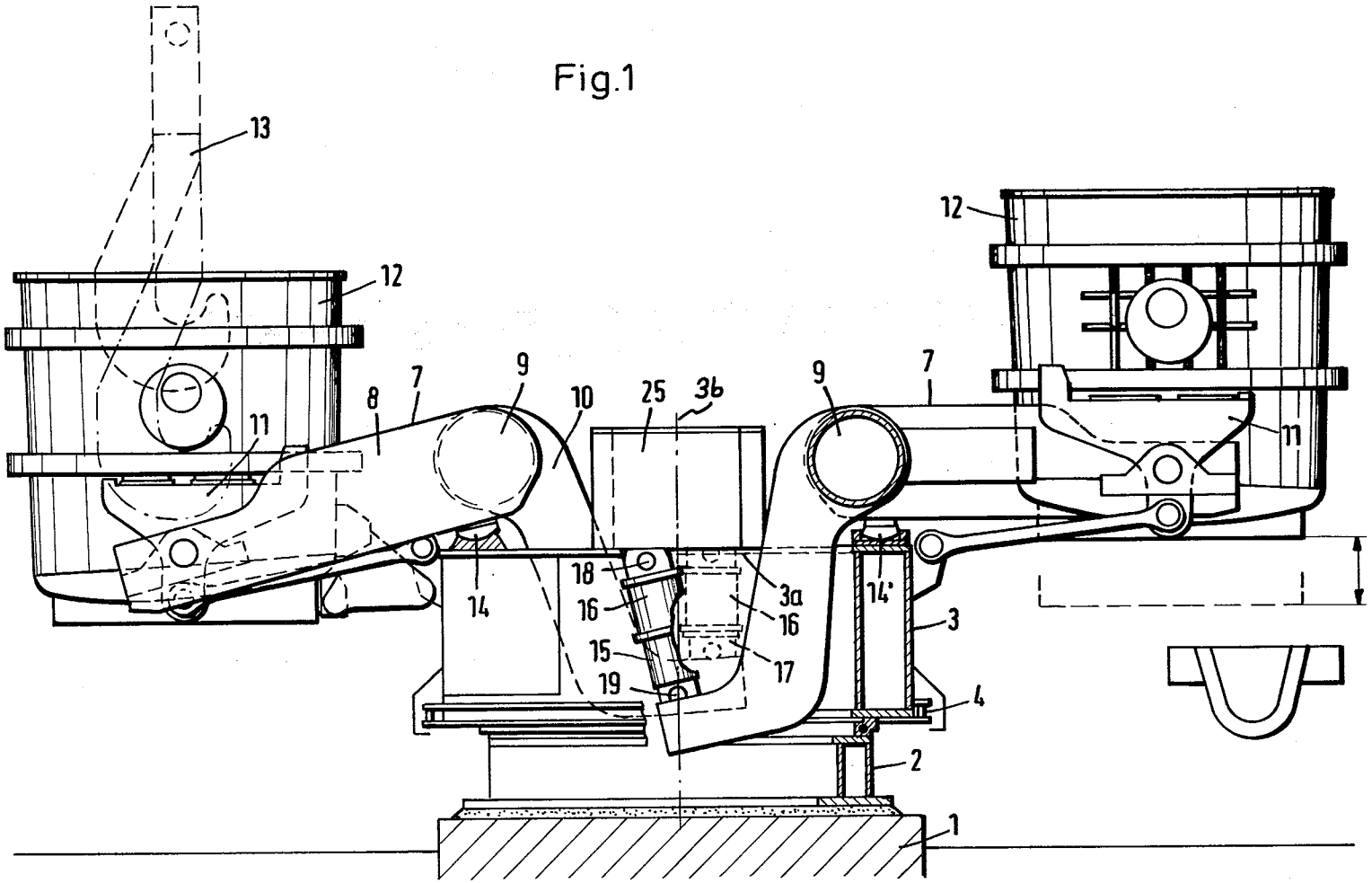
FIG. 1 is a side elevational view of a revolving tower for ladles illustrating the invention.
Figure 2:
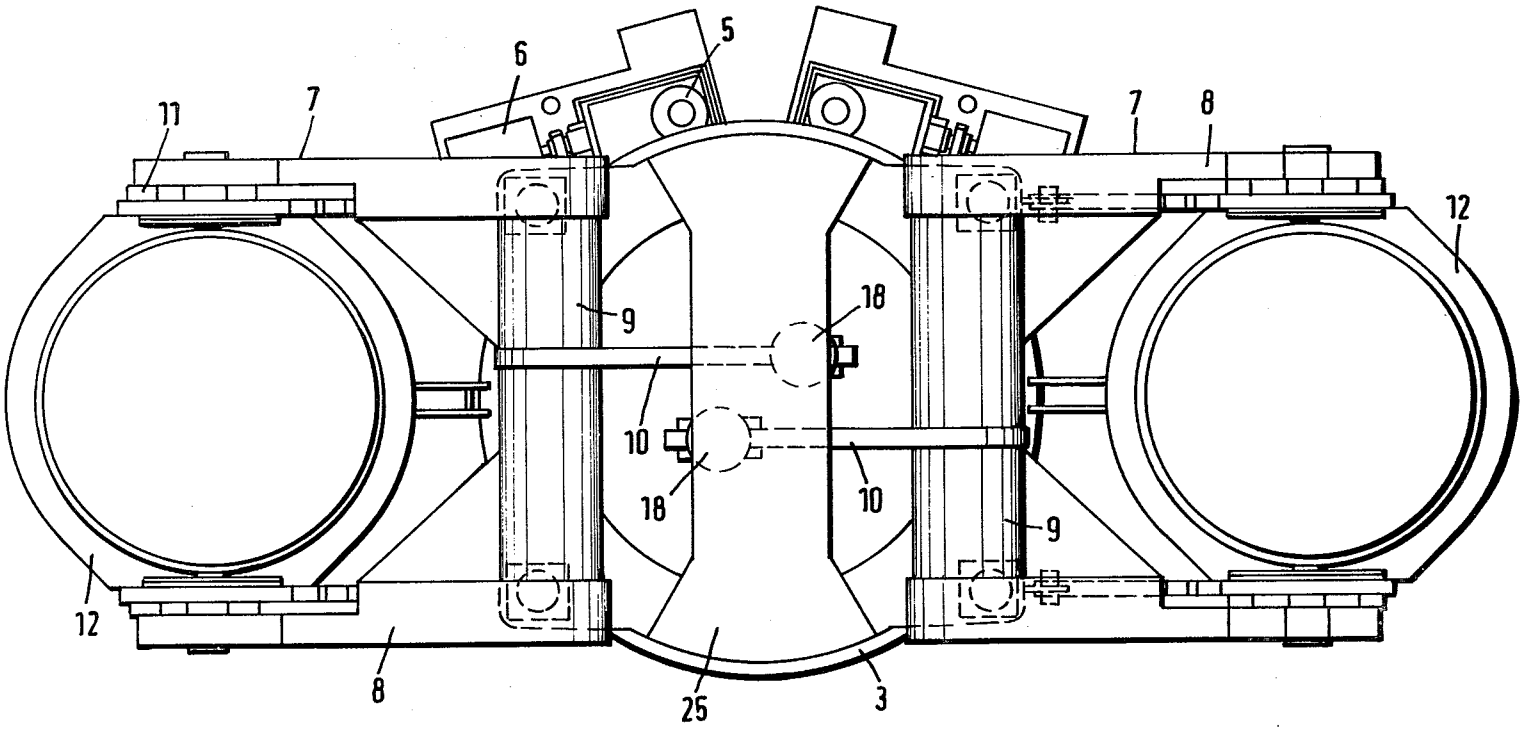
FIG. 2 is a top plan view of the apparatus of FIG. 1.

FIG. 1 shows a support frame 2, attached to a pedestal 1. A rotary-driven annular support 3 pivots on the frame 2. The rotary axis 3*b* of annular support 3 is, simultaneously, the rotary axis for the entire revolving tower. The lower portion of annular support 3 is provided with a circular track 4 engaging with the pinions 5 of a stationary rotary gear 6 (FIG. 2). The annular support 3 is relatively low in height. The sides of annular support 3, as well as its upper base, are reinforced or braced as they are subject to great stress.

The revolving tower is equipped with two oppositely support or extending levers 7, essentially symmetrical with rotary axis 3*b*, and working independently. The levers are forked as viewed in plan and as shown in FIG. 2. Each lever consists of two load arms 8 extending essentially perpendicular to the rotary axis of the revolving tower, being firmly connected by means of a torsion-resistant cross beam 9. As FIG. 2 shows, each pair of load arms 8 form a U-shape or fork with its respective cross beam 9 when viewed in plan.

A power arm 10 is welded to the cross beam 9. FIG. 2 shows that the power arms 10, for structural reasons, are staggered or displaced from each other on a horizontal plane. The example shows has the power arms 10 essentially angled vertically downward in the shape of a Z, so that the lower end portion of each power arm 10, as viewed in elevation, extends roughly parallel with its associated load arms 8.

The free ends of load arms 8 are provided with receivers 11, of essentially standard construction, for casting ladles 12. In FIG. 1, on the left side, the hook 13 of a crane, not shown, is shown, by means of which the casting ladle is, among other things, inserted into receiver 11, or lifted off the receiver.

The two levers 7 are arranged to be tiltable on the top of the upper base of the annular support 3. The tilting motion taking place in a vertical plane, and is limited accordingly. The levers 7 rest on the base area 3*a* in bearings 14, 14' which are open in plan view. The example shown has as bearing 14 a spherical axial hinge bearing, while the bearing 14' is shown as consisting of a spherical hob or devolution bearing. The different types of bearings are shown as examples only. Naturally, bearings of one type only are always used for a revolving tower. This bearing arrangement is provided with lift controls, not shown, as protection against unintentional stress from shock.

The swivel movements of each lever 7 is induced by a hoisting element, which in the example shown, is a cylinder-piston arrangement 15 operated by a pressurized fluid, positioned adjacent the rotary axis 3*b* of the revolving tower, and within the annular support 3, essentially in a vertical direction. The pressure cylinders 16 are hinged at 18 to the bottom 3*a* of a cross beam 25, attached to the annular support 3 by means of screws, while the piston rods 17 are hinged at 19 to the power arms 10. As the drawings show, the load arms 8 are relatively long. This makes for a great lift with little lateral displacement.

In the example shown each power arm 10 is advantageously hinged to the piston rod 17 of each cylinder-piston arrangement 15. This obviates a special terminal position control, since the cylinder is positioned adjacent to the lever in the terminal position of the cylinder-piston 15. Also, several cylinders may be used with each power arm. However, the same torsional resistance of the cross beam must be maintained, so that the load may be sustained in case of failure of one cylinder.

Hoisting elements may consist of electro-mechanical gears, such as one or several strain and/or stress lifting spindles or screw jacks for lifting the load, instead of pressure cylinders. The revolving tower of this invention may also include weighing elements, which can be advantageously arranged under the lever bearing.

I claim:

1. A rotatable support for casting ladles comprising
(a) a base;
(b) a support rotatable on said base;
(c) a pair of oppositely extending support levers mounted for vertical articulation on said support;
(d) a casting ladle receiver mounted in the end of each support lever opposite said rotatable support;
(e) a cross beam forming the inner end of each said support lever;
(f) a power arm fixed on each cross beam;
(g) power means extending between said rotatable support and each said power arm; the improvement characterized by
(h) each said support lever includes a pair of spaced arms extending from their respective cross beam;
(i) bearing means on said rotatable support for the vertical articulation of each of said support levers;
(j) each bearing means being open topped; and
(k) said rotatable support is annular.

2. The apparatus of claim 1, further characterized by
(a) each said power arm is angled downwardly from its respective cross beam.

3. The apparatus of claim 2, further characterized by
(a) each said power arm is Z-shaped.

4. The apparatus of claim 2, further characterized by
(a) each said power arm is L-shaped.

5. The apparatus of claim 2, further characterized by
(a) each said power arm extends into said annular support.

6. The apparatus of claim 1, further characterized by
(a) a transverse support beam on said annular support;
(b) each said power means being vertical and connected to said transverse support; and
(c) the connection of each said power means to said transverse support being adjacent the axis of said annular support.

7. The apparatus of claim 6, further characterized by
(a) each said power means is a pressure fluid operated piston-cylinder arrangement.

8. The apparatus of claim 7, further characterized by (a) the piston rod of each said piston-cylinder arrangement is attached to its respective power arm.

9. The apparatus of claim 1, further characterized by (a) each said open topped bearing means are arcuate axial hinge bearings.

10. The apparatus of claim 1, further characterized by (a) each said open topped bearing means are arcuate hob bearings.

* * * * *